US007413200B2

(12) United States Patent
Horn

(10) Patent No.: US 7,413,200 B2
(45) Date of Patent: Aug. 19, 2008

(54) SKATEBOARD TRUCK WITH SINGLE-PIN, PIVOTAL, REVERSIBLE ATTACHMENT BETWEEN AXEL AND BASE PLATE, AND MEANS OF IMPROVING A USER'S SHREDDING CAPABILITIES THROUGH USE OF THE SKATEBOARD TRUCK WITH SINGLE-PIN, PIVOTAL ATTACHMENT BETWEEN AXEL AND BASE PLATE

(76) Inventor: Bradford E. Horn, P.O. Box 3778, Dana Point, CA (US) 92629

( * ) Notice: Subject to any disclaimer, the term of this patent is extended or adjusted under 35 U.S.C. 154(b) by 201 days.

(21) Appl. No.: 11/327,729

(22) Filed: Jan. 9, 2006

(65) Prior Publication Data

US 2007/0164530 A1 Jul. 19, 2007

(51) Int. Cl.
*A63C 17/02* (2006.01)

(52) U.S. Cl. ..... 280/87.042; 280/11.27; 280/11.28

(58) Field of Classification Search ..... 280/87.042, 280/87.041, 87.03, 11.27, 11.28
See application file for complete search history.

(56) References Cited

U.S. PATENT DOCUMENTS 2,763,490 A * 9/1956 Crone ..... 280/11.28
3,235,282 A 2/1966 Bostick
4,047,725 A 9/1977 Pinchock
4,071,256 A 1/1978 Kimmell
4,109,925 A * 8/1978 Williams et al. ..... 280/11.28
4,120,508 A 10/1978 Brown et al.
4,245,848 A * 1/1981 Dudouyt ..... 280/11.28
4,251,087 A * 2/1981 Hansen ..... 280/11.28
4,311,319 A 1/1982 Snyder et al.
4,398,734 A 8/1983 Barnard
4,596,396 A * 6/1986 Merbler ..... 280/11.28
4,898,398 A 2/1990 Cassel
5,052,702 A 10/1991 Chan
5,169,166 A 12/1992 Brooks
5,232,235 A 8/1993 Brooks
5,330,214 A 7/1994 Brooks et al.
5,372,384 A 12/1994 Smith
5,458,351 A 10/1995 Yu
5,522,620 A 6/1996 Pracas
5,853,182 A 12/1998 Finkle
5,879,013 A 3/1999 Shih
5,971,411 A 10/1999 Jones et al.
5,975,546 A 11/1999 Strand
6,056,302 A 5/2000 Smith
6,182,987 B1 2/2001 Bryant
6,315,304 B1 * 11/2001 Kirkland et al. ..... 280/11.28
6,315,312 B1 * 11/2001 Reyes et al. ..... 280/87.042
6,428,023 B2 * 8/2002 Reyes et al. ..... 280/87.042
6,467,782 B1 * 10/2002 Smith ..... 280/87.042
6,474,666 B1 * 11/2002 Andersen et al. ..... 280/87.041

(Continued)

*Primary Examiner*—Jeffrey J Restifo
(74) *Attorney, Agent, or Firm*—Eric Hanscom; Todd Langford

(57) ABSTRACT

A skateboard truck with a single kingpin assembly mechanism with a compressible single bushing with a graduated coefficient of compressibility and built-in cam stops. The truck allows for superior rotation of the wheels due to the single kingpin assembly, which presents an improvement over the prior king-pin and bolt, as there is less stress on the moving parts, the danger of wheel-bite is reduced, and a tighter steering angle can be maintained. The axle hanger is reversible to allow a user to change the height of the skateboard deck from the surface. Because it is made from fewer parts, the truck is simpler to construct, take apart and repair, and can be made less expensively than traditional trucks.

19 Claims, 2 Drawing Sheets

U.S. PATENT DOCUMENTS 6,523,837 B2 * 2/2003 Kirkland ..... 280/11.28
6,547,262 B1 * 4/2003 Yamada et al. ..... 280/11.28
6,739,603 B1 * 5/2004 Powell ..... 280/11.27
7,093,842 B2 * 8/2006 Chmelar ..... 280/87.042
7,104,558 B1 * 9/2006 Saldana ..... 280/87.042
7,150,460 B2 * 12/2006 Williams ..... 280/87.042
7,219,907 B2 * 5/2007 Chang ..... 280/87.042
2006/0097470 A1 * 5/2006 Chmelar ..... 280/87.042

* cited by examiner

SKATEBOARD TRUCK WITH SINGLE-PIN, PIVOTAL, REVERSIBLE ATTACHMENT BETWEEN AXEL AND BASE PLATE, AND MEANS OF IMPROVING A USER'S SHREDDING CAPABILITIES THROUGH USE OF THE SKATEBOARD TRUCK WITH SINGLE-PIN, PIVOTAL ATTACHMENT BETWEEN AXEL AND BASE PLATE

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

This invention is directed toward a skateboard truck with a single king-pin assembly mechanism with a compressible single bushing and built-in cam stops, preferably designed for a longboard style of skateboard. The truck allows for superior rotation of the wheels due to the single kingpin assembly, which presents an improvement over the prior king-pin and bolt, as there is less stress on the moving parts, the danger of wheel-bite is reduced, and a tighter steering angle can be maintained. Because it is made from fewer parts, the truck is simpler to construct, take apart and repair, and can be made less expensively than traditional trucks. The truck is also reversible, thereby allowing a user to mount his/her wheels closer to the deck of the skateboard.

The sport of skateboarding began in the 1960's as an offshoot of surfing. Because skateboards can be used anywhere there are hard surfaces, such as streets and sidewalks, and are not limited to coastal areas with decent surf, it has eclipsed the popularity of surfing many times over both in terms of numbers of participants and size of the industry. As would be expected with such a developed sport, skateboards and their components have evolved over the four decades or so since the first person took the wheels off an old pair of roller skates and put them on the underside of a piece of wood.

The modern skateboard comprises several basic components, including a riding surface, or deck, usually made of an elongated piece of wood, fiberglass or some other sturdy, resilient and flexible material, four wheels with some sort of ball bearing arrangement upon which the deck and rider are transported, and two skateboard trucks, where the trucks are the devices by which the wheels are connected to the deck. The trucks are attached to the deck in a mirror image manner, such that as a user leans on one side of the skateboard, the forces cause each truck to simultaneously steer in the opposite direction that the other truck steers. While located in a fairly unobtrusive location on the underside of the deck, the trucks are very important as they determine how the skater controls his/her skateboard by determining how a skateboard's wheels turn. A person doubting the importance of the trucks merely needs to try a quick straight-line trip down a winding hill on a skateboard with trucks which do not allow the skateboard wheels to turn before realizing the folly of such an opinion.

Skateboard trucks are made in a wide variety of styles which rely upon several basic components, within which there can be significant variation. The basic components of the modern skateboard include a base plate or a truck mounting plate, which is a flat piece of metal with at least four holes along its edges, which is used to screw or bolt the truck to the bottom of the deck, a bolt, which attaches the wheel-mounting axle to the base plate, and an upward-projecting, wheel-mounting axle which suspends the skateboard wheels on either side of the kingpin and has a single truck axle or kingpin which sits in a protected cup or pin-receiving hole in the base plate. The turning ability of the skateboard depends on the design and adjustments made to the kingpin, as the wheels of the skateboard traditionally pivot around the kingpin. The bolt is generally threaded through an oversized hole lined with compressible and resilient bushings, often made of plastic components such as urethane, such that by tightening the bolt it becomes more difficult to flex the axle, and therefore more difficult to turn the skateboard (tightening the bolt also generally tends to make the skateboard more stable and less susceptible to "wobble" at high speeds, so there is an inherent trade-off between a user's desire for skateboard maneuverability and stability at high speeds). As the user leans from side to side, the bolt presses against the bushings, enabling turning and at the same time compressing the bushings, such that further leaning becomes more and more difficult for the user. The skateboard user steers the skateboard by leaning from one side to another. thereby applying pressure to the truck, such that the truck pivots around the truck axles whereby on the front wheels, the outer wheel moves forward while the inside wheel moves back, and on the rear wheels, the outer wheel moves back and the inner wheel moves forward, thereby causing the two sets of wheels to no longer be in alignment but rather to describe an arc through which the skateboard will now travel presuming the rider balances successfully on the skateboard.

While modern skateboard trucks perform the basic required operations of attaching the wheels to the deck and allow the user to turn the skateboard by leaning it on one side or another, many of the current trucks have a number of disadvantages including:

1. Existing skateboard trucks limit the turning ability of the skateboards as they allow unacceptably small axle rotation unless the rider loosens the bushings so much that the board develops an undesirable wobble at higher speeds.

2. The poor turning ability causes particular problems when a rider has to perform a tight U-turn, in which case most riders have to dismount their skateboards and pick up the board with their hands to turn it around, or perform a potentially dangerous maneuver, particularly for less-than-expert riders, in which the rider releases or shifts weight from the front axle to the back axle, lifting the front of the board up in the air, and pirouetting around the back axle. While this maneuver can be performed eloquently by skilled riders, a novice rider more often that not will end up with a bruised bottom or worse.

3. Traditional skateboard trucks rely on two points of connection between the base plate and the axle—namely, a kingpin and a bolt. Because of the arrangement of these two members, the force exerted by the bolt or kingpin pivoting around the other puts a potentially damaging amount of stress on, usually, the kingpin. A damaged kingpin can quickly turn a $50 skateboard truck into a piece of scrap good only for salvage value of any unbent bolts, washers, and nuts. A broken kingpin can quickly turn a fun ride into an ambulance trip, or worse.

The current invention can be used on all lengths of skateboards, and is particularly adapted toward the "longboard" skateboards, which are a fairly recent skateboard style. The term "longboard" comes from the surfer's slang term for a surfboard which is generally more than nine feet long, with 50/50 rails, less nose rocker than a standard shortboard, and generally rad cruising abilities. Longboard skateboards are longer than traditional skateboards—usually at least three feet in length. With the added weight and length, longboard skateboards require not only different skills in a rider, but also different equipment to compensate for their unique size and shapes. For example, with a longer deck, the longboard skateboard does not perform optimally when using the same trucks that are used with traditional, twenty-four inch or less, skateboards due to "wheel bind". Wheel bind occurs in longboard skateboards when the trucks are not designed to allow a user of a longboard skateboard to turn sharply without causing the wheel axles to turn inward to an unacceptably large degree such that the wheels bind and not be smoothly restored to a forward direction. Wheel bind also occurs in shorter skateboards as well, so the invention provides a superior method of turning for all lengths of skateboards.

Thus there has existed a long-felt need for a skateboard truck which avoids the wheel binding problems traditionally encountered with longboards and reduces the physical stress on the truck. While this invention was developed to respond to wheel bind in longboards, it also provides similar advantages when used with traditional skateboards as well.

The current invention provides just such a solution by providing a skateboard truck with a single kingpin assembly mechanism with a compressible single bushing and built-in cam stops. The truck allows for superior rotation of the wheels due to the single kingpin assembly, which presents an improvement over the prior kingpin and bolt, as there is less stress on the moving parts, the danger of wheel-bite is reduced, and a tighter steering angle can be maintained. Because it is made from fewer parts, the truck is simpler to construct, take apart and repair, and can be made less expensively than traditional trucks.

SUMMARY OF THE INVENTION

It is a principal object of the invention to provide a skateboard truck with improved turning ability combined with a lack of rail bite.

Other objects of the invention include:

Providing a skateboard truck that is comprised of fewer parts than is a standard skateboard truck, thereby making the skateboard truck cheaper to manufacture, easier to assemble, and easier to take apart for cleaning or replacement of components.

Providing a skateboard truck that attaches the wheels to the deck with only a single kingpin as the means of attachment, and does not require a second point of attachment—traditionally a bolt in traditional trucks—between the wheels and deck.

Providing a skateboard truck where the wheels rotate rather than pivot around one of two points of attachment.

Providing a skateboard truck with superior turning abilities where such abilities are not dependent upon over-loosening of a bushing, but rather having a single kingpin assembly with cam stops and a urethane bushing.

Removing the stress on the truck components inherent in a kingpin/bolt system.

Providing a skateboard truck that is reversible such that a user can reverse the axle hanger so that the wheels are much closer to the deck of the skateboard, thereby allowing a user to skateboard with the deck closer to the surface, thereby enhancing stability and providing a lower center of gravity.

Using a single bushing of compressible urethane or other suitable material with a coefficient of compressibility that causes additional increments of pressure to result in increased degrees of resistance, such that the skateboard's turning ability is not dependant upon loose bushings.

Providing cam stops on the hanger unit and the base unit such that as the bushing is compressed, it serves as a buffer such that by the time a user has applied enough pressure to cause the cam stops to meet, the bushing has absorbed so much of the energy that the meeting of the cams is more gentle than would be the case with a bushing with a straight-line coefficient of compressibility.

Providing a skateboard truck with a bushing with anti-rotational cavities and a base bushing receptacle with anti-rotational plugs, and a hanger bushing receptacle with anti-rotational plugs, such that the anti-rotational plugs in the base and hanger hold the bushing in place.

Providing a skateboard truck which allows for a tight turning radius without requiring the rider to shift his/her weight to the rear truck and pirouette the lifted front truck around the back truck.

Providing a skateboard truck which maintains the stability of the skateboard and eliminates wobble through the entire range of bushing settings and adjustments.

Providing a skateboard truck which allows a variable and adjustable steering response.

It is a final object of this invention to provide a skateboard truck that is made from few parts such that assembly of the truck is simple and manufacture of the truck is inexpensive compared with other trucks.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

This invention is directed toward a skateboard truck with a single kingpin assembly mechanism with a compressible, single bushing and built-in cam stops, preferably designed for a longboard style of skateboard. The truck allows for superior rotation of the wheels due to the single kingpin assembly, which presents an improvement over the prior kingpin and bolt, as there is less stress on the moving parts, the danger of wheel-bite is reduced, and a tighter steering angle can be maintained. Because it is made from fewer parts, the truck is simpler to construct, take apart and repair, and can be made less expensively than traditional trucks.

Figure 1:
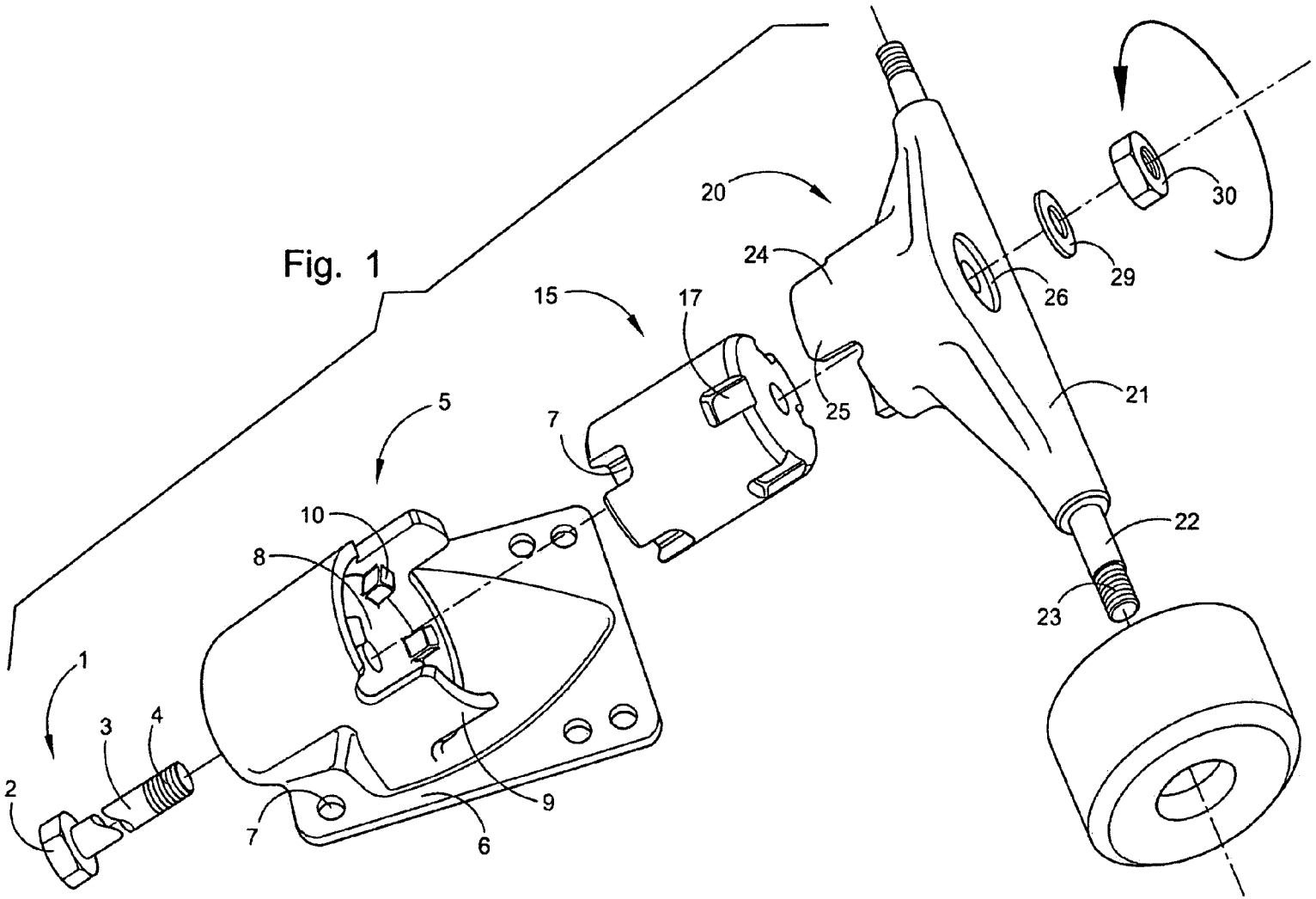
FIGS. 1*a* and 1*b* are a top and side, perspective exploded view of the invention, showing the components and how they fit together.

FIGS. 1*a* and 1*b* illustrate the components of the skateboard truck and how they fit together. The invention consists of few pieces, relative to traditional skateboard trucks. Replacing the traditional kingpin and bolt is a single kingpin, referred to generally by 1, consisting of a kingpin head (2), a kingpin body (3), and a plurality of kingpin threads (4). The kingpin (1) is pushed through holes in three other components before being removably attached to a nut (30) with a plurality of threads which mate with the kingpin threads (4). By tightening or loosening the nut, the user of the skateboard truck can adjust the case of turning the skateboard. Attaching the invention to the bottom of the deck of a skateboard is a base unit, made of metal, generally referred to by number 5. The base unit consists of a base (6), which is a flat plate with two or more attachment holes (7), through which the base unit can be attached to the bottom of the skateboard deck by screws or bolts. The base unit (5) also has a base bushing receptacle section (8), which has a roughly cylindrical cavity in its center, and a hole at its bottom end through which the kingpin can fit. Inside the bushing receptacle section (8) there are two or more anti-rotational plugs (10), and two or more base cam stops (9) at the top.

Fitting into the base bushing receptacle section (8) is a bushing, generally referred to by number 15. The bushing (15) has a bushing kingpin hole (16) and at least two anti-rotational cavities (17) on both its bottom section and its top section. The bushing is roughly cylindrical in design and is made from urethane. The urethane from which the bushing (15) is made has a graduated coefficient of compressibility, such that it does not compress at a set rate, but rather, it compresses fairly easily when lightly pressurized, but takes increasingly more pressure to cause the same amount of deformation under higher amounts of pressure. This graduation compressibility becomes important as the turning ability of the skateboard is dependent upon, among other factors, the compressibility of the urethane. The improvement in the bushing is one of the key parts of this invention, as the anti-rotational plugs and cavities keep the bushing stationary and the graduated coefficient of compressibility allows for a gentler meeting of the cam stops.

The bushing (15) has a top section which fits into hanger (generally referred to by number 20), which is the third component in between the kingpin (1) and the nut (30), with a hanger kingpin hole (26). The hanger (20) has an axle section (21) which has a hole through which an axle (22) fits. The axle (22) protrudes from either side of the hanger such that a skateboard wheel can be hung on either end and has axle threads (23). The hanger also has a hanger bushing receptacle section (24), which has a roughly cylindrical cavity in its center, and a hanger kingpin hole (26) at its bottom end through which the kingpin can fit. Inside the hanger bushing receptacle section (24) there are two or more anti-rotational plugs (not visible in this figure but similar and shape, structure, and function to the anti-rotational plugs (10) in the base unit (5), and two or more base cam stops (25) at the bottom.

It should be noted that the hanger is designed to be reversible, such that a user who wishes to have his/her skateboard lower to ground, for a lower center of gravity and enhanced stability, can merely unscrew the kingpin and reverse the hanger. By doing this, the wheels are moved much closer to the underside of the deck of the skateboard, such that when the skateboard is flipped over to us, the deck of the skateboard sits substantially lower than it would were the hangers left in their initial positions. While the reversal of the hanger may increase the danger of "wheel bite", the user of the invention can take precautions such as cutting out wheel wells in the skateboard or attaching the invention to a skateboard with raised wheel wells or with the wheel wells already cut out.

The last two parts of the invention are a washer (29) and a nut (30), which serve to attach the different parts of the invention to each other and provide a mechanism by which the user of the invention can adjustably tighten or loosen the kingpin to adjust the turning abilities of the skateboard.

The function of the invention is fairly simple and provides a superior performance with fewer parts that are found in traditional skateboard trucks. The bushing is made of a compressible urethane or other suitable material with a coefficient of compressibility that causes additional increments of pressure to result in increased degrees of resistance. The bushing is held in place between the base unit and hanger by the anti-rotational plugs in the base unit and hanger, and the anti-rotational cavities in the bushing, so that the bushing does not get pinched or cut by the other parts of the invention, or migrate out of its desired location.

As the use puts pressure on one side of the other of the skateboard, the bushing is compressed and the hanger, to which the wheels are attached, rotates about the kingpin. In traditional skateboard truck designs, the wheels would continue to rotate until either a) the tightness of the bolt and kingpin prevented further turning, or b) the wheel touched the bottom of the deck of the skateboard—an unfortunate situation called "wheel bite" where the skateboard suddenly brakes to a halt and the rider usually flies off the skateboard and tumbles to the ground, often sustaining injuries to the knees, hands, wrists, and head. With the current invention, however, both the base unit and the hanger have cam stops, which prevent the wheels from rotating to the point where they touch the bottom of the deck of the skateboard, as the cam stops halt this rotation before "wheel bite" occurs.

Figure 3:
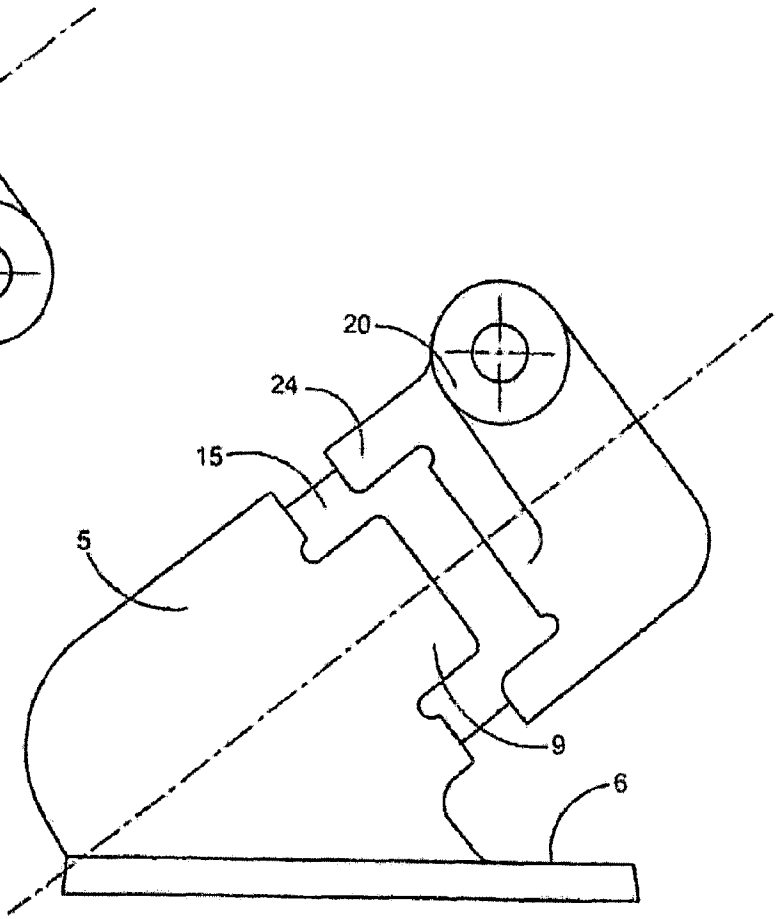
FIGS. 2 and 3 are perspective views of the hanger being rotated to allow the skateboard rider to use the skateboard with the deck of the skateboard at two different elevations off the ground.
Figure 2:
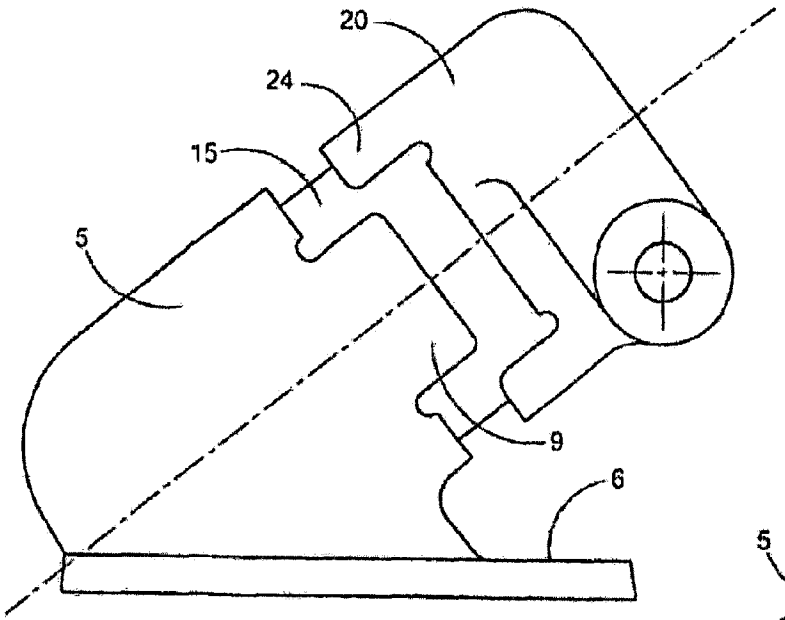

FIGS. 2 and 3 illustrate how the hanger can be reversed to allow a skateboard rider to change the amount of space between the skateboard deck and the riding surface. After removing the kingpin nut (30 in FIG. 1), the hanger 20 can be removed from the kingpin (not shown in this figure) and rotated 180 degrees, then reinserted onto the kingpin and compressed upon the bushing 15 by tightening the kingpin nut. Because the axle 20 is located to one side of the hanger kingpin hole, reversing the hanger changes the distance between the wheels and the deck of the skateboard. This different results in two different elevations for the skateboard deck above the skating surface, as illustrated by the different locations of the axel in FIG. 2 and FIG. 3. Thus, for different types of skating performance, a skater can adjust whether he/she rides "high" or "low" by merely rotating the hanger.

I claim:

1. A skateboard truck, comprising:

a kingpin consisting of a head portion, a body portion, and a plurality of kingpin threads, a base consisting of a flat portion through which exist two or more attachment holes for attaching the base to the bottom of the deck of a skateboard and a base bushing receptacle portion which has a roughly cylindrical cavity into which the bushing fits, a hole through which the kingpin fits, a bushing with a kingpin hole through the center of a diameter sufficient to allow the kingpin to pass, a hanger unit consisting of an axle with axle threads at both ends, a hanger body through which the axle fits, a hanger bushing receptacle of a size sufficient to allow the bushing to be inserted, a hole through which the kingpin fits, and a nut with threads which mate with the kingpin threads, such that by attaching the base to a skateboard, attaching two wheels to the axle, and threading the kingpin through, in order, the base, the bushing, the hanger, and the nut, the wheels can be attached to the skateboard with only one axis of contact, such that when a rider places weight on one side or the other of the skateboard, the wheels rotate about the kingpin without relying on a secondary member for support or as a pivot axis, where the base additionally comprises two or more cam stops and the hanger additionally comprises two or more cam stops, where each of the two or more cam stops on the base is opposite to one of the two or more cam stops on the hanger, and where when the base and hanger are removably attached to one another by the kingpin and the nut, with the bushing in between the base and the hanger, the cam stops of the base have a set gap between them and the cam stops of the hanger, where the two or more cam stops of the base extend beyond the two or more cam stops of the hanger such that a cam stop of the base engages an opposite cam stop of the hanger, thereby allowing the hanger a certain range of rotational motion before each base cam stop meet its opposite hanger cam stop and prevent further rotation of the hanger, which thereby limits the amount of movement of the wheels.

2. The skateboard truck of claim 1, where the kingpin is the sole connecting member between the base, the bushing, and the hanger, and the bushing is made from urethane.

3. The skateboard truck of claim 1, where the base additionally comprises four or more anti-rotational plugs arrayed around the bottom of the base bushing receptacle, the bushing has a graduated coefficient of compressibility, and the bushing additionally comprises four or more anti-rotational cavities arrayed around the bottom of the bushing and four or more anti-rotational cavities arrayed around the top of the bushing, and the hanger additionally comprises four or more anti-rotational plugs arrayed around the top of the hanger bushing receptacle, such that the base, bushing, and hanger cannot rotate around the other.

4. The skateboard truck of claim 1, where the base contains two cam stops and the hanger contains two cam stops.

5. The skateboard truck of claim 1, where the bushing is cylindrical in shape.

6. The skateboard truck of claim 1, where the hanger is reversible such that by reversing the hanger a user can change the distance between the wheels and the deck of the skateboard.

7. The skateboard truck of claim 1, where, the kingpin angle to the bottom of the deck of the skateboard is substantially 30 degrees to the vertical.

8. The skateboard truck of claim 1, where, the kingpin angle to the bottom of the deck of the skateboard is substantially 35 degrees to the vertical.

9. The skateboard truck of claim 1, where, the kingpin angle to the bottom of the deck of the skateboard is substantially 40 degrees to the vertical.

10. The skateboard truck of claim 1, where, the kingpin angle to the bottom of the deck of the skateboard is substantially 45 degrees to the vertical.

11. The skateboard truck of claim 1, where, the kingpin angle to the bottom of the deck of the skateboard is substantially 50 degrees to the vertical.

12. The skateboard truck of claim 1, where, the kingpin angle to the bottom of the deck of the skateboard is substantially 55 degrees to the vertical.

13. The skateboard truck of claim 1, where, the only member between the base and the hanger is the bushing and the only connecting device is the kingpin.

14. The skateboard truck of claim 1, where, the amount of pressure a rider needs to exert to make a turn can be adjusted by tightening the nut on the kingpin and adding or removing pressure from the bushing, without the use of any flanges or other devices other than the kingpin, the nut, and the bushing.

15. The skateboard truck of claim 1, where, upon receiving pressure from a rider putting pressure on one side or the other of the skateboard, the hanger rotates about the kingpin at the angle the kingpin is set to the bottom of the skateboard.

16. A skateboard truck, comprising:

a kingpin consisting of a head portion, a body portion, and a plurality of kingpin threads, a base consisting of a flat portion through which exist two or more attachment holes for attaching the base to the bottom of the deck of a skateboard and a base bushing receptacle portion which has a roughly cylindrical cavity into which the bushing fits, a hole through which the kingpin fits, a bushing with a kingpin hole through the center of a diameter sufficient to allow the kingpin to pass, a hanger unit consisting of an axle with axle threads at both ends, a hanger body through which the axle fits, a hanger bushing receptacle of a size sufficient to allow the bushing to be inserted, a hole through which the kingpin fits, and a nut with threads which mate with the kingpin threads, such that by attaching the base to a skateboard, attaching two wheels to the axle, and threading the kingpin through, in order, the base, the bushing, the hanger, and the nut, the wheels can be attached to the skateboard with only one axis of contact, such that when a rider places weight on one side or the other of the skateboard, the wheels rotate about the kingpin without relying on a secondary member for support or as a pivot axis, and, where the hanger is reversible such that by reversing the hanger a user can change the distance between the wheels and the deck of the skateboard.

17. A skateboard truck, comprising:

a kingpin consisting of a head portion, a body portion, and a plurality of kingpin threads, a base consisting of a flat portion through which exist two or more attachment holes for attaching the base to the bottom of the deck of a skateboard and a base bushing receptacle portion which has a roughly cylindrical cavity into which the bushing fits, a hole through which the kingpin fits, a bushing with a kingpin hole through the center of a diameter sufficient to allow the kingpin to pass, a hanger unit consisting of an axle with axle threads at both ends, a hanger body through which the axle fits, a hanger bushing receptacle of a size sufficient to allow the bushing to be inserted, a hole through which the kingpin fits, and a nut with threads which mate with the kingpin threads, such that by attaching the base to a skateboard, attaching two wheels to the axle, and threading the kingpin through, in order, the base, the bushing, the hanger, and the nut, the wheels can be attached to the skateboard with only one axis of contact, such that when a rider places weight on one side or the other of the skateboard, the wheels rotate about the kingpin without relying on a secondary member for support or as a pivot axis, where the base additionally comprises two or more cam stops and the hanger additionally comprises two or more cam stops, where each of the two or more cam stops on the base is opposite to one of the two or more cam stops on the hanger, and where when the base and hanger are removably attached to one another by the kingpin and the nut, with the bushing in between the base and the hanger, the cam stops of the base have a set gap between them and the cam stops of the hanger, where the two or more cam stops of the base extend beyond the two or more cam stops of the hanger such that a cam stop of the base engages an opposite cam stop of the hanger, thereby allowing the hanger a certain range of rotational motion before each base cam stop meet its opposite hanger cam stop and prevent further rotation of the hanger, which thereby limits the amount of movement of the wheels, and, where the hanger is reversible such that by reversing the hanger a user can change the distance between the wheels and the deck of the skateboard.

18. The skateboard truck of claim 17, where, the bushing has a graduated coefficient of compressibility.

19. The skateboard truck of claim 17, where, the kingpin angle to the bottom of the deck of the skateboard is between 30 and 55 degrees to the vertical.

* * * * *